US011059623B1

(12) United States Patent
Ecker et al.

(10) Patent No.: US 11,059,623 B1
(45) Date of Patent: Jul. 13, 2021

(54) SELF-LOCKING STRUCTURE FOR ISOLATION DAMPER BASED PLATFORMS

(71) Applicant: INTERNATIONAL BUSINESS MACHINES CORPORATION, Armonk, NY (US)

(72) Inventors: Richard M. Ecker, Poughkeepsie, NY (US); Budy Notohardjono, Poughkeepsie, NY (US); Suraush Khambati, Poughkeepsie, NY (US); Shawn Canfield, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 16/801,421

(22) Filed: Feb. 26, 2020

(51) Int. Cl.
*B65D 19/40* (2006.01)

(52) U.S. Cl.
CPC .... *B65D 19/40* (2013.01); *B65D 2519/00273* (2013.01); *B65D 2519/00378* (2013.01); *B65D 2519/00552* (2013.01)

(58) Field of Classification Search
CPC ..... B65D 19/38; F16M 7/00; F16F 15/04
USPC ..... 108/57.12; 248/615, 562, 565, 566, 638
See application file for complete search history.

(56) References Cited

U.S. PATENT DOCUMENTS 1,747,352 A * 2/1930 Devine, Jr. ..... E01F 1/005 248/621
1,812,861 A * 7/1931 Sherwood ..... B62B 3/0625 108/57.12
2,319,735 A * 5/1943 Hussman ..... F16F 13/00 267/135
2,788,842 A * 4/1957 Ohlenkamp ..... B60N 2/38 248/566
2,908,456 A * 10/1959 Gertel ..... F16F 7/08 248/566

(Continued)

FOREIGN PATENT DOCUMENTS

JP 05033826 A * 2/1993
WO 9961330 A1 12/1999

OTHER PUBLICATIONS

Limer, "Do You Really Know How a Retractable Pen Works?", Popular Mechanics, https://www.popularmechanics.com/technology/gadgets/a17437/how-a-re . . . , Sep. 22, 2015, pp. 1-5.

(Continued)

*Primary Examiner* — Jose V Chen
(74) *Attorney, Agent, or Firm* — Tihon Poltavets

(57) ABSTRACT

A self-locking structure includes an enclosure and a plunger assembly, where plunger assembly is movable within the enclosure in a vertical direction. An upper platform coupled to the plunger assembly, where the upper platform is configured to move in the same vertical direction as the plunger assembly. A lower platform coupled to the enclosure, where at least one isolation damper is disposed between a top surface of the lower platform and a bottom surface of the upper platform configured to compress under a load applied to a top surface of the upper platform. The plunger assembly includes a first locking finger, where the first locking finger is configured to engage with a first locking aperture of the enclosure when the at least one isolation damper is compressed under the load applied to the top surface of the upper platform.

17 Claims, 5 Drawing Sheets

(56) References Cited

U.S. PATENT DOCUMENTS

| | | | | |
|---|---|---|---|---|
| 3,267,882 | A * | 8/1966 | Rapson | B60V 3/02 108/51.11 |
| 3,426,986 | A * | 2/1969 | Pool | A47B 91/04 248/616 |
| 3,545,707 | A * | 12/1970 | Orii Sho | B60B 33/06 248/615 |
| 4,267,781 | A | 5/1981 | Powers | |
| 4,342,446 | A | 8/1982 | Eaton | |
| 4,362,287 | A * | 12/1982 | Grongstad | F16F 15/023 248/563 |
| 4,533,109 | A * | 8/1985 | Delam | E01D 19/04 188/381 |
| 4,589,799 | A | 5/1986 | Hotta | |
| 4,604,014 | A | 8/1986 | Frano | |
| 4,722,505 | A * | 2/1988 | Kaiser | G11B 33/08 248/561 |
| 5,588,371 | A * | 12/1996 | Looker | B65D 19/0095 108/57.12 |
| 5,603,266 | A | 2/1997 | Nash | |
| 6,418,862 | B1 * | 7/2002 | Heil | B65D 19/0028 108/57.12 |
| 7,175,150 | B2 * | 2/2007 | Chi | F16F 3/10 248/562 |
| 7,681,735 | B2 | 3/2010 | Youell, Jr. | |
| 7,744,050 | B2 * | 6/2010 | de Toledo | A47L 15/4253 248/188.3 |
| 7,779,765 | B2 | 8/2010 | Donnell, Jr. | |
| 7,938,070 | B2 * | 5/2011 | Shea | B65D 19/0028 108/56.3 |
| 8,561,962 | B1 * | 10/2013 | Butts | F16F 9/486 248/638 |
| 8,720,350 | B2 * | 5/2014 | Bush | B65D 19/0073 108/57.12 |
| 8,777,193 | B2 | 7/2014 | Loret De Mola | |
| 9,227,757 | B1 * | 1/2016 | Green | B65D 19/0095 |
| 9,284,107 | B2 * | 3/2016 | Schultz | B65D 19/44 |
| 9,291,234 | B1 * | 3/2016 | Green | B65D 19/40 |
| 9,950,834 | B2 * | 4/2018 | Tunks | H05K 7/1488 |
| 10,093,450 | B2 | 10/2018 | Embleton | |
| 2003/0047121 | A1 * | 3/2003 | Gruber | F16F 15/08 108/57.12 |
| 2007/0221102 | A1 * | 9/2007 | Reinhall | B65D 19/0073 108/57.12 |
| 2008/0093514 | A1 | 4/2008 | Carnevali | |
| 2016/0061285 | A1 | 3/2016 | Green | |
| 2019/0170290 | A1 * | 6/2019 | Carton | F24F 1/40 |
| 2020/0240560 | A1 * | 7/2020 | Wicklow | F16B 7/06 |

OTHER PUBLICATIONS

Siemon Interconnect Products, "V600 42U Shock Pallet and Ramp", printed Aug. 6, 2019, files.siemon.com/int.../siemon-v600-42u-shock-pallet-and-ramp_spec-sheet.pdf, pp. 1-8.

* cited by examiner

SELF-LOCKING STRUCTURE FOR ISOLATION DAMPER BASED PLATFORMS

FIELD OF THE INVENTION

This disclosure relates generally to load leveling and stabilization, and in particular, to a self-locking structure for leveling and stabilization of variable weight loads on isolation damper-based platforms.

BACKGROUND OF THE INVENTION

A pallet that transports a variable weight load (e.g., mainframe computer) typically includes an upper platform for loading and a lower support platform separated by isolation dampers (e.g., rubber and roam) positioned at each corner of the variable weight load. The isolation dampers compensate for the variable weight of the load on the lower platform by compressing at different heights, where a load experienced at each corner of the lower platform of the pallet varies. In order to provide stability to the variable weight load, the lower platform is bolted down at each corner to the lower support platform subsequent to compression of the isolation dampers as a result of the variable weight load being applied to the lower platform. Each corner of the lower platform is manually bolted down to the lower support platform, where instances of overtightening of the bolts can result in instability of the variable weight load on the lower platform of the pallet.

SUMMARY

One aspect of an embodiment of the present invention discloses an apparatus for a self-locking structure, the apparatus comprising an enclosure and a plunger assembly, wherein the plunger assembly is movable within the enclosure in a vertical direction The apparatus further comprising an upper platform coupled to the plunger assembly, wherein the upper platform is configured to move in the same vertical direction as the plunger assembly. The apparatus further comprising a lower platform coupled to the enclosure, wherein at least one isolation damper is disposed between a top surface of the lower platform and a bottom surface of the upper platform configured to compress under a load applied to a top surface of the upper platform. The plunger assembly includes a first locking finger, wherein the first locking finger is configured to engage with a first locking aperture of the enclosure when the at least one isolation damper is compressed under the load applied to the top surface of the upper platform.

BRIEF DESCRIPTION OF THE SEVERAL VIEWS OF THE DRAWINGS

The following detailed description, given by way of example and not intended to limit the disclosure solely thereto, will best be appreciated in conjunction with the accompanying drawings, in which.

DETAILED DESCRIPTION

Figure 1:
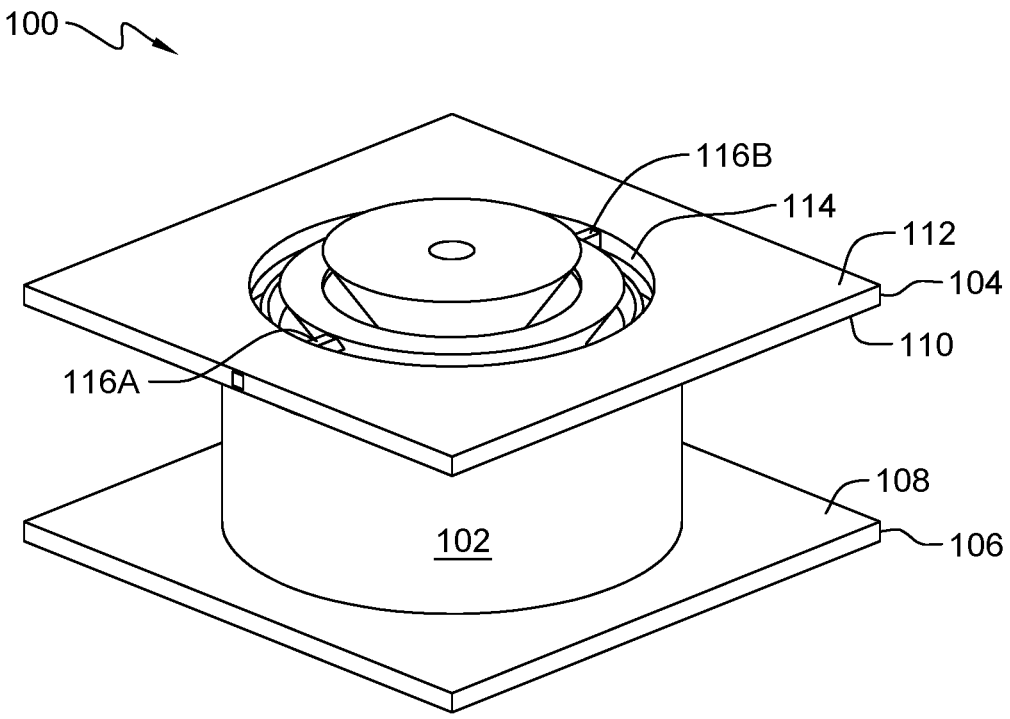
FIG. 1 depicts a three-dimensional view of a self-locking structure surrounded by an isolation damper between an upper platform and a lower platform, in accordance with an embodiment of the present invention.

Embodiments of the present invention provide a self-locking structure comprising an enclosure and a plunger assembly, where the self-locking structure is utilized in conjunction with one or more isolation dampers. The one or more isolation dampers are positioned between an upper platform that is moveable and a lower platform that is fixed. The upper platform is coupled to the plunger assembly and the lower platform is coupled to the enclosure, where the plunger assembly is movable in a vertical direction (i.e., y-axis direction) of the enclosure. As a load is applied to the upper platform, the one or more isolation dampers compress causing the upper platform to move in a downward vertical direction (i.e., —y-axis direction), along with the plunger assembly in the enclosure. The plunger assembly includes locking fingers for engaging and disengaging with one or more corresponding locking apertures on the enclosure. The plunger assembly also includes a plunger and locking mechanism, where the plunger and locking mechanism in a locked state prevents the two or more locking fingers from disengaging with the corresponding locking apertures on the enclosure. For pallet-based applications, a self-locking structure would be placed at each corner of a quadrilateral shaped pallet to provide securement subsequent to compression of the one or more isolation dampers. Having the self-locking structure at each corner of the pallet allows for engagement of each self-locking structure under static loading, while providing similar stability and isolation at each corner during dynamic conditions experienced during the movement of the pallet.

Detailed embodiments of the present invention are disclosed herein with reference to the accompanying drawings; however, it is to be understood that the disclosed embodiments are merely illustrative of potential embodiments of the invention and may take various forms. In addition, each of the examples given in connection with the various embodiments is also intended to be illustrative, and not restrictive. This description is intended to be interpreted merely as a representative basis for teaching one skilled in the art to variously employ the various aspects of the present disclosure. In the description, details of well-known features and techniques may be omitted to avoid unnecessarily obscuring the presented embodiments.

For purposes of the description hereinafter, terms such as "upper", "lower", "right", "left", "vertical", "horizontal", "top", "bottom", and derivatives thereof shall relate to the disclosed structures and methods, as oriented in the drawing figures. Terms such as "above", "overlying", "atop", "on top", "positioned on" or "positioned atop" mean that a first element, such as a first structure or first member, is present on a second element, such as a second structure or second member, wherein intervening elements, such as an interface structure may be present between the first element and the second element. The term "direct contact" means that a first element, such as a first structure, and a second element, such as a second structure, are connected without any intermediary conducting, insulating or semiconductor layers at the interface of the two elements. The term substantially, or substantially similar, refer to instances in which the difference in length, height, or orientation convey no practical difference between the definite recitation (e.g. the phrase sans the substantially similar term), and the substantially similar variations. In one embodiment, substantial (and its derivatives) denote a difference by a generally accepted engineering or manufacturing tolerance for similar devices, up to, for example, 10% deviation in value or 10° deviation in angle.

In the interest of not obscuring the presentation of embodiments of the present invention, in the following detailed description, some processing steps or operations that are known in the art may have been combined together for presentation and for illustration purposes and in some instances may have not been described in detail. In other instances, some processing steps or operations that are known in the art may not be described at all. It should be understood that the following description is rather focused on the distinctive features or elements of various embodiments of the present invention.

FIG. 1 depicts a three-dimensional view of a self-locking structure surrounded by an isolation damper between an upper platform and a lower platform, in accordance with an embodiment of the present invention. In this embodiment, self-locking structure 100 is surrounded by isolation damper 102, where isolation damper 102 is positioned between upper platform 104 and lower platform 106. A first end of isolation damper 102 is disposed on top surface 108 of lower platform 106 and bottom surface 110 of upper platform 104 is disposed on a second end of isolation damper 102. Isolation damper 102 is a compressible material (e.g., foam, rubber) that provides structural support for upper platform 104, where lower platform 104 is fixed and upper platform 104 is movable in the vertical direction (i.e., y-axis direction) when a load is applied to loading surface 112 of upper platform 104. As isolation damper 102 compresses due to a load applied to loading surface 112 on upper platform 104, self-locking structure 100 locks upper platform 104 relative to lower platform 106 upon isolation damper 102 reaching a final compressed positioned. Self-locking structure 100 is coupled to top surface 108 of lower platform 106 and coupled to upper platform 104 utilizing pins 116A and 116B, where pin 116A is positioned at a first side of self-locking structure 100 and pin 116B is positioned at a second side of self-locking structure 100. Pins 116A and 116B couple upper platform 104 to plunger assembly of self-locking structure 100 (discussed in further detail with regards to FIG. 2.)

For pallet-based applications where a variable weight load is applied to loading surface 112 on upper platform 104, self-locking structure 100 is positioned at each corner of a quadrilateral shaped pallet. The variable weight load applied to loading surface 112 on upper platform 104 is not disposed over upper platform aperture 114 of upper platform 104, to allow for clearance of movement of self-locking structure 100 (discussed in further detail with regards to FIGS. 9 and 10). In other embodiments, self-locking structures 100 are positioned at each corner of a pallet and a plurality of isolation dampers of varying heights and cross sections are positioned between upper platform 104 and lower platform 106, where the plurality of isolation dampers are engaged for different weighted loads applied to loading surface 112 on upper platform 104. A position of one or more isolation dampers 102 between upper platform 104 and lower platform 106 is application based and load dependent, where the position of isolation damper 102 surrounding self-locking structure 100 in FIG. 1 serves as an example of one embodiment of the present invention.

Figure 2:
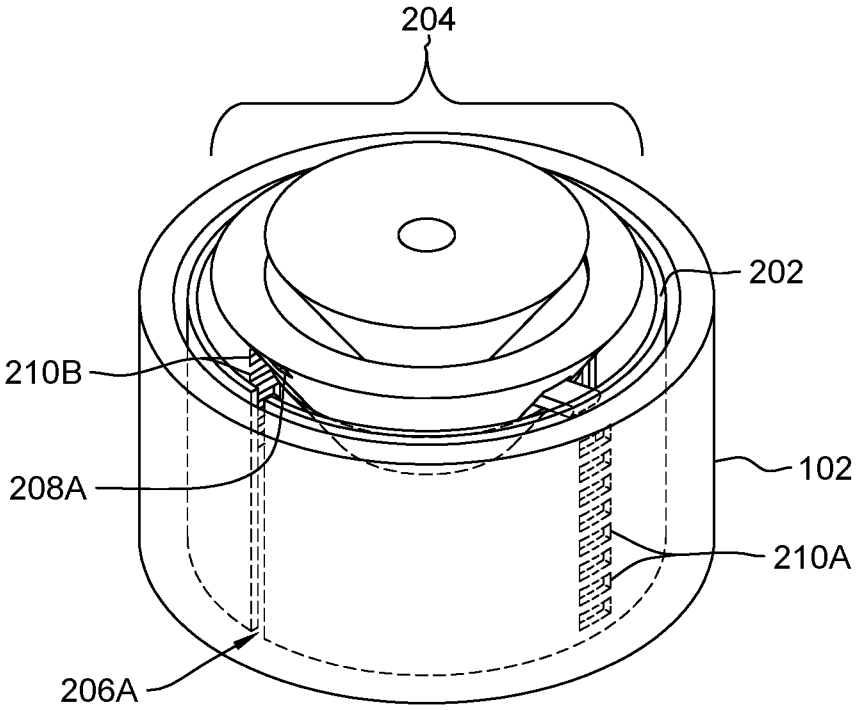
FIG. 2 depicts a three-dimensional view of a self-locking structure surrounded by an isolation damper depicted in a transparent view, in accordance with an embodiment of the present invention.

FIG. 2 depicts a three-dimensional view of a self-locking structure surrounded by an isolation damper depicted in a transparent view, in accordance with an embodiment of the present invention. As previously discussed in FIG. 1, in this embodiment isolation damper 102 surrounds self-locking structure 100, where self-locking structure 100 is disposed within a cylindrical tube structure of isolation damper 102. In other embodiments, isolation damper 102 at least partially surrounds self-locking structure 100. Self-locking structure 100 includes enclosure 202 and plunger assembly 204, where enclosure 202 includes cavity guides 206A and 206B for placement of pins 116A and 116B, respectively. Cavity guide 206B is positioned at the second side of self-locking structure 100 opposite the first side of self-locking structure 100, where cavity guide 206B is not illustrated in FIG. 2. Pins 116A and 116B are insertable into cavity 208A and 208B of a plunger housing of plunger assembly 204 (discussed in further detail with regards to FIG. 4). Cavity 208B is positioned at the second side of self-locking structure 100 opposite the first side of self-locking structure 100, where cavity 208B is not illustrated in FIG. 2. Enclosure 202 further includes locking apertures 210A and 210B arranged in a vertical manner along the y-axis for placement of two locking fingers of plunger assembly 204 (discussed in further detail with regards to FIG. 4). Locking apertures 210A are positioned at a third side of self-locking structure 100 opposite a fourth side of self-locking structure 100. In this embodiment, the first side, the second side, the third side, and the fourth side of self-locking structure 100 are separated by 90°.

Figure 3:
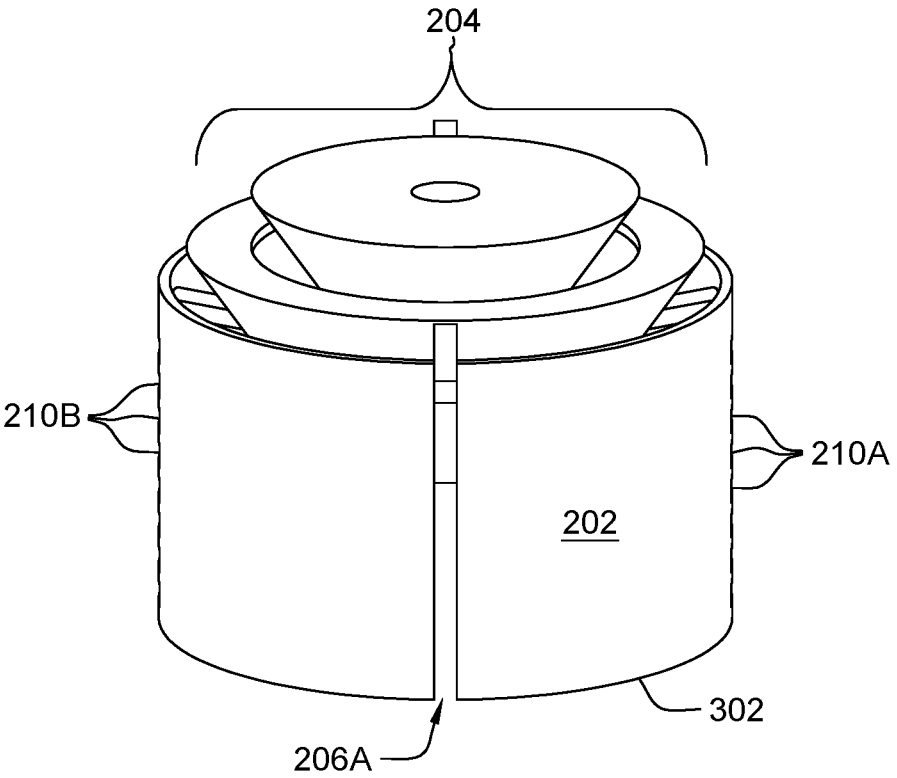
FIG. 3 depicts a three-dimensional view of a self-locking structure, in accordance with an embodiment of the present invention.

FIG. 3 depicts a three-dimensional view of a self-locking structure, in accordance with an embodiment of the present invention. In this embodiment, enclosure 202 of self-locking structure 100 includes two halves, where cavity guide 206A and 206B (not illustrated in FIG. 3) separate the two halves (i.e., portions) of enclosure 202. As previously discussed, self-locking structure 100 is coupled to top surface 108 of lower platform 106, where lower surface 302 of each portion of enclosure 202 couples to top surface 108. In this embodiment, cavity guide 206A and 206B of enclosure 202 each run an entire vertical length (i.e., height) of enclosure 202 along the y-axis. In other embodiments, cavity guide 206A and 206B of enclosure 202 each run a portion of a vertical height, where enclosure 202 is a single body without two separate halves. Locking apertures 210A are positioned on a first portion of enclosure 202 and locking apertures 210B are positioned on a second portion of enclosure 202, where locking apertures 210A are positioned opposite locking apertures 210B.

Figure 4:
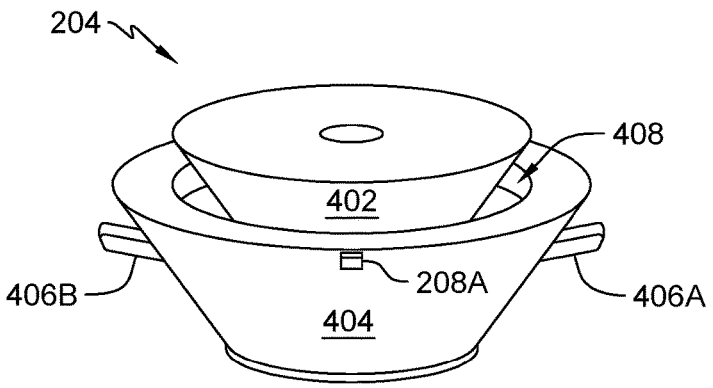
FIG. 4 depicts a three-dimensional view of a plunger assembly of a self-locking structure, in accordance with an embodiment of the present invention.

FIG. 4 depicts a three-dimensional view of a plunger assembly of a self-locking structure, in accordance with an embodiment of the present invention. Plunger assembly 204 includes plunger 402, plunger housing 404, locking finger 406A, locking finger 406B, and a plunger locking mechanism (discussed in further detail with regards to FIG. 5). In this embodiment, plunger 402 and plunger housing 404 are each funnel shaped, where plunger 402 and the plunging mechanism are disposed within plunger housing cavity 408 of plunger housing 404. Plunger 402 is configured to extend out of and retract into cavity 408 of plunger housing 408 in a vertical direction (i.e., y-axis direction) via the plunger locking mechanism. Locking finger 406A and 406B protruding from plunger housing 404 and are configured to interlock with locking apertures 210A and 210B, respectively on enclosure 202. A first end of locking finger 406A is coupled to a first pin and rotational spring combination, where the first pin and rotational spring combination is configured to extend and retract locking finger 406A from plunger housing 404. A first end of locking finger 406B is coupled to a second pin and rotational spring combination, where the second pin and rotational spring combination is configured to extend and retract locking finger 406B from plunger housing 404. As previously discussed, pins 116A and 116B for coupling plunger assembly 204 to upper platform 104 are insertable into cavity 208A and 208B of plunger housing 404 of plunger assembly 204. Cavity 208B is positioned opposite cavity 208A, where cavity 208B is not illustrated in FIG. 4.

Figure 5:
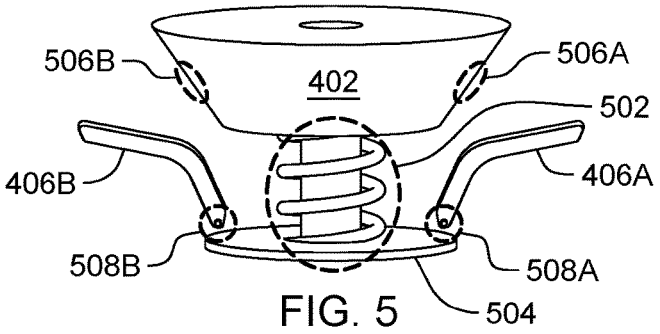
FIG. 5 depicts an exploded view of a plunger assembly with a plunger housing removed, in accordance with an embodiment of the present invention.

FIG. 5 depicts an exploded view of a plunger assembly with a plunger housing removed, in accordance with an embodiment of the present invention. Plunger housing 404 of plunger assembly 204 is removed for illustrative and discussion purposes. Plunger locking mechanism 502 is coupled to plunger 402 and base plate 504, where base plate 504 is coupled to a lower surface of plunger housing 404. Plunger locking mechanism 502 is configured to lock and unlock plunger 402 within plunger housing 404, along with locking fingers 406A and 406B. Plunger locking mechanism 502 in a locked position prevents the vertical movement of plunger assembly 204 disposed in enclosure 202 by engaging a second end of locking fingers 406A and 406B in a corresponding aperture of locking apertures 210A and 210B, respectively. In the locked position, where plunger 402 is retracted within plunger housing 404, plunger surface 506A prevents locking finger 406A from pivoting at first pin and rotational spring combination 508A at the first end of locking finger 406A. Similarly, plunger surface 506B prevents locking finger 406B from pivoting at second pin and rotational spring combination 508B at the first end of finger 406B.

In the unlocked positioned, where plunger 402 extends out of plunger housing 404, a first gap is present between plunger surface 506A and locking finger 406A. The first gap allows for locking finger 406A to pivot at first pin and rotational spring combination 508A at the first end of locking finger 406A, thus disengaging the second end of locking finger 406A with a corresponding aperture of locking aperture 210A. Similarly, when plunger 402 extends out of plunger housing 404, a second gap is present between plunger surface 506B and locking finger 406B. The second gap allows for locking finger 406B to pivot at second pin and rotational spring combination 508B at the first end of locking finger 406B, thus disengaging the second end of locking finger 406B with a corresponding aperture of locking aperture 210B.

Locking mechanism 502 is configured to allow for a user to apply a force (i.e., press down) on a top surface of plunger 402, which results in locking mechanism 502 securing locking plunger 402 within plunger housing 404 (i.e., locked state). Locking mechanism 502 is further configured to allow for a user to apply another force (i.e., press down) on the top surface of plunger 402, which results in locking mechanism releasing locking plunger 402 from plunger housing 404 (i.e., unlocked state). Locking mechanism 502 can includes a frame, a thruster, two cams, a guide pin, and a spring. The spring provides a tension required to retract and extend plunger 402 from plunger housing 404. The two cams provide a bistable system, where a first position of the bistable system retracts plunger 402 from plunger housing 404 and a second position of the bistable system extends plunger 402 from plunger housing 404. The force is applied on the top surface of plunger 402, locking mechanism 502 moves between the first and second position and vice versa. The guide pin can be integrated into the lower surface of plunger 402 to provide structural stability to the spring, where the guide pin can pass through an aperture in base plate 504 (discussed in further detail with regards to FIG. 6).

Figure 6:
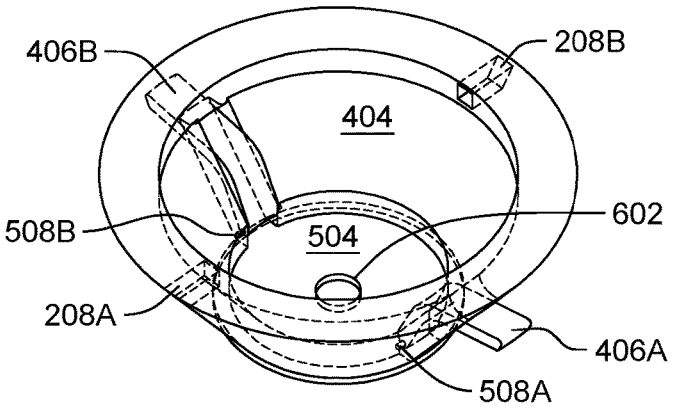
FIG. 6 depicts a three-dimensional view of a plunger assembly with a plunger and locking mechanism removed, in accordance with an embodiment of the present invention.

FIG. 6 depicts a three-dimensional view of a plunger assembly with a plunger and locking mechanism removed, in accordance with an embodiment of the present invention. Plunger 402 and locking mechanism 502 are removed for illustrative and discussion purposes. As previously discussed, plunger housing 404 includes cavity 208A and 208B for insertion of pins 116A and 116B for coupling upper platform 104 to plunger assembly 204. Pins 116A and 116B ensure that the downward vertical movement (i.e., —y-axis direction) of upper platform 104 during the compression of isolation damper 102 is translated to plunger assembly 204 disposed in enclosure 202. First pin and rotational spring combination 508A mechanical couples locking finger 406A to plunger housing 404 and second pin and rotational spring combination 508B mechanical couples locking finger 406B to plunger housing 404. Aperture 602 in base plate 504 is configured to allow for guide pin to pass through during the retraction and extension of plunger 402 from plunger housing 404.

Figure 7:
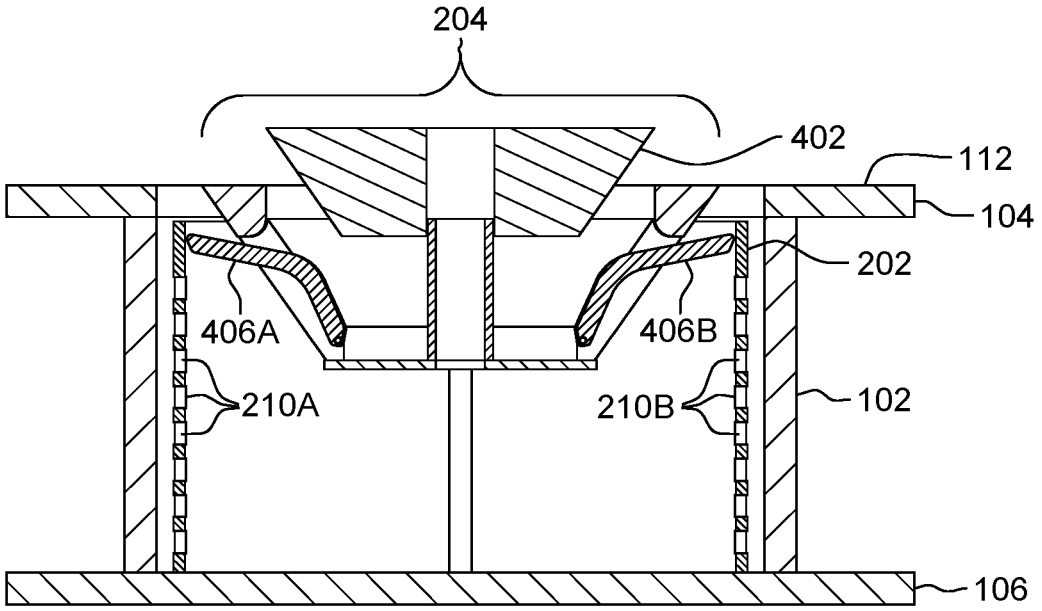
FIG. 7 depicts a cross sectional view of a plunger assembly in a decompressed and disengaged state prior to a load being applied to an upper platform, in accordance with an embodiment of the present invention.

FIG. 7 depicts a cross sectional view of a plunger assembly in a decompressed and disengaged state prior to a load being applied to an upper platform, in accordance with an embodiment of the present invention. In a decompressed state, isolation damper 102 positioned between upper platform 104 and lower platform 106 is not experiencing a load on loading surface 112. In a disengaged state, locking fingers 406A and 406B are retracted within enclosure 202 and are disengaged with a corresponding aperture of locking apertures 210A and 210B, respectively. The locking mechanism for plunger 402 is in an unlocked state. As a result, plunger assembly 204 is free to move in a vertical direction (i.e., y-axis direction) within enclosure 202 when a load is applied to loading surface 112 of upper platform 104. Since upper platform 104 is coupled to plunger assembly 204 utilizing pins 116A and 116B (not illustrated in FIG. 7), upper platform 104 is movable along the y-axis with plunger assembly 204, while enclosure 202 and lower platform 106 remain in a fixed position.

Figure 8:
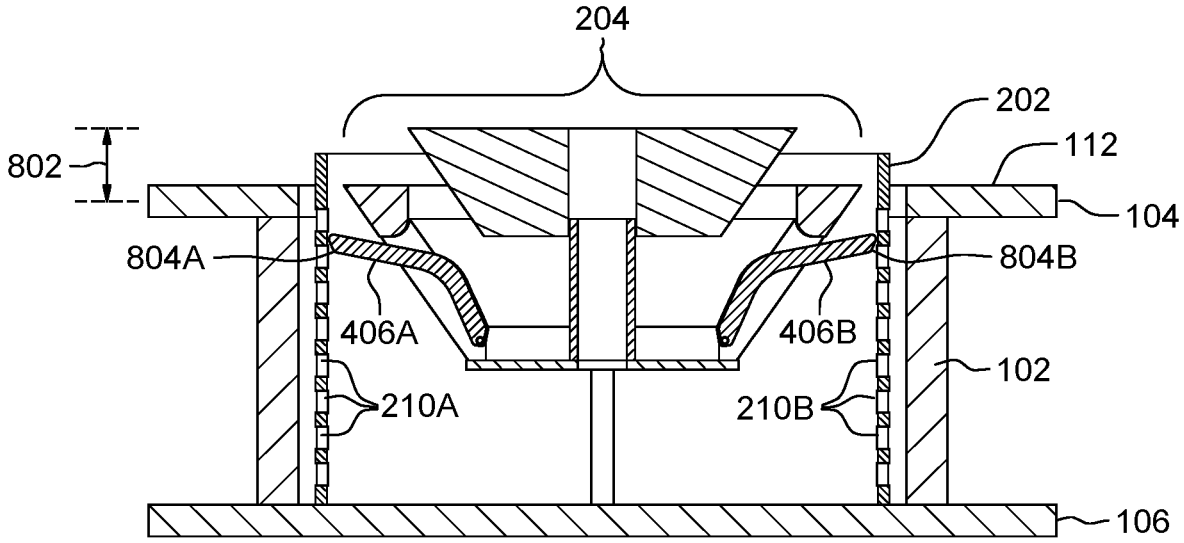
FIG. 8 depicts a cross sectional view of a plunger assembly in a transition phase with a load being applied to an upper platform, in accordance with an embodiment of the present invention.

FIG. 8 depicts a cross sectional view of a plunger assembly in a transition phase with a load being applied to an upper platform, in accordance with an embodiment of the present invention. In the transition phase, isolation damper 102 is compressing as a load is being applied to loading surface 112 of upper platform 104. As previously discussed, enclosure 202 and lower platform 106 remain fixed, while upper platform 104 and plunger assembly 204 move in a downward direction (i.e., —y-axis direction). Transition height 802 illustrates an amount of compression experienced by isolation damper 102 during the transition phase. During the transition phase, locking fingers 406A and 406B of plunger assembly 204 remain retracted within enclosure 202 and are disengaged with a corresponding aperture of locking apertures 210A and 210B, respectively (i.e., disengaged state).

The second ends of locking fingers 406A and 406B included angled edges 804A and 804B, respectively. As plunger assembly 204 travels in the downward direction, locking finger 406A engages with a first corresponding aperture of locking apertures 210A. As the plunger assembly 204 continues to travel in the downward direction, angled edge 804A allows for locking finger 406A to pivot at first pin and rotational spring combination 508A at the first end of locking finger 406A and disengage with the first corresponding aperture of locking apertures 210A. Subsequently, locking finger 406A can engage with a second corresponding aperture (below the first corresponding aperture) of locking apertures 210A. Similarly, as plunger assembly 204 travels in the downward direction, locking finger 406B engages with a first corresponding aperture of locking apertures 210B. As the plunger assembly 204 continues to travel in the downward direction, angled edge 804B allows for locking finger 406B to pivot at second pin and rotational spring combination 508B at the first end of locking finger 406B and disengage with the first corresponding aperture of locking apertures 210B. Subsequently, locking finger 406B can engage with a second corresponding aperture (below the first corresponding aperture) of locking apertures 210B.

Figure 9:
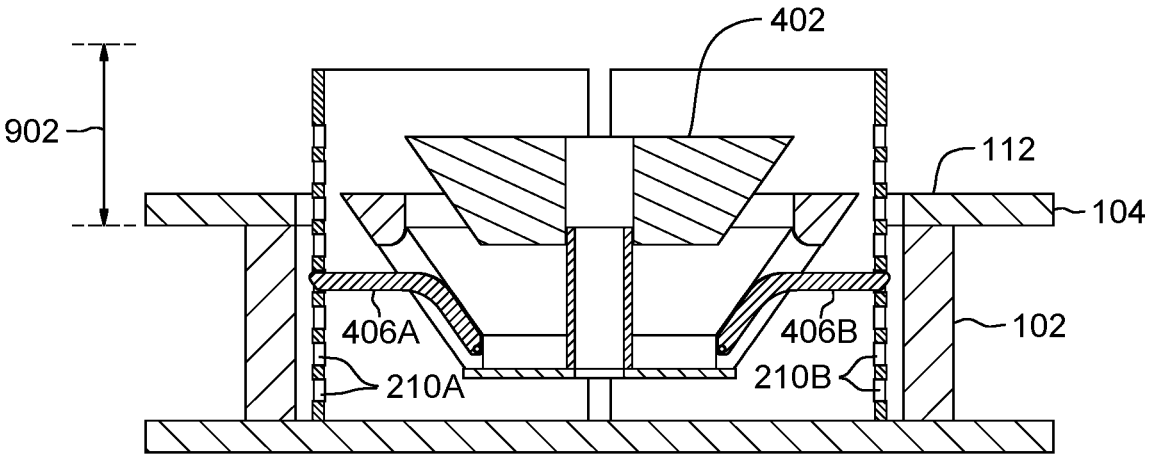
FIG. 9 depicts a cross sectional view of a plunger assembly in a compressed state with a load applied to an upper platform, in accordance with an embodiment of the present invention.

FIG. 9 depicts a cross sectional view of a plunger assembly in a compressed state with a load applied to an upper platform, in accordance with an embodiment of the present invention. In the compressed state, isolation damper 102 reaches a final position and is compressed due to the load being applied to loading surface 112 on upper platform 104. In the final position, compression height 902 illustrates an amount of total compression experienced by isolation damper 102 due to the load being applied to loading surface 112 on upper platform 104. Locking finger 406A is engaged with a corresponding aperture of locking apertures 210A and locking finger 406B is engaged with a corresponding aperture of locking apertures 210B. However, the locking mechanism for plunger 402 is illustrated as being in an unlocked state.

Figure 10:
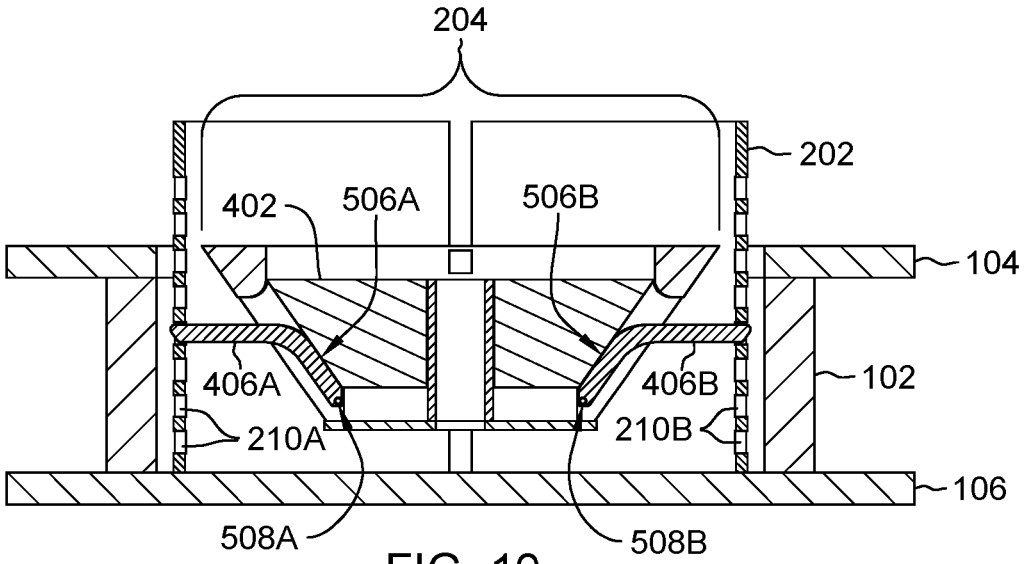
FIG. 10 depicts a cross sectional view of a plunger assembly in a compressed state and an engaged state with a load applied to an upper platform, in accordance with an embodiment of the present invention.

FIG. 10 depicts a cross sectional view of a plunger assembly in a compressed state and an engaged state with a load applied to an upper platform, in accordance with an embodiment of the present invention. In a compressed state, isolation damper 102 positioned between upper platform 104 and lower platform 106 is experiencing a load on loading surface 112. In an engaged state, locking fingers 406A and 406B are extended through enclosure 202 and are engaged with a corresponding aperture of locking apertures 210A and 210B, respectively. The locking mechanism for plunger 402 is in a locked state and plunger assembly 204 is locked from moving in a vertical direction (i.e., y-axis direction) within enclosure 202. As a result, upper platform 104 is now in a fixed position relative to lower platform 106. As previously discussed, in the locked position, where plunger 402 is retracted within plunger housing 404, plunger surface 506A prevents locking finger 406A from pivoting at first pin and rotational spring combination 508A at the first end of locking finger 406A. Similarly, plunger surface 506B prevents locking finger 406B from pivoting at second pin and rotational spring combination 508B at the first end of locking finger 406B. In some embodiments, a height of each aperture from locking apertures 210A and 210B is such to allow for a minimal amount of movement for upper platform 104 and plunger assembly 204. For example, a first height of each aperture from locking apertures 210A and 210B can be twice a second height of each locking finger 406A and 406B, where a difference in the first height and the second height define an amount of possible vertical movement by upper platform 104 and plunger assembly 204.

The terminology used herein is for the purpose of describing particular embodiments only and is not intended to be limiting to the invention. As used herein, the singular forms "a", "an" and "the" are intended to include the plural forms as well, unless the context clearly indicates otherwise.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiment, the practical application or technical improvement over technologies found in the marketplace, or to enable other of ordinary skill in the art to understand the embodiments disclosed herein. It is therefore intended that the present invention not be limited to the exact forms and details described and illustrated but fall within the scope of the appended claims.

What is claimed is:

1. An apparatus for a self-locking structure, the apparatus comprising:

an enclosure and a plunger assembly, wherein the plunger assembly is movable within the enclosure in a vertical direction;

an upper platform coupled to the plunger assembly, wherein the upper platform is configured to move in a similar vertical direction as the plunger assembly;

a lower platform coupled to the enclosure, wherein at least one isolation damper is disposed between a top surface of the lower platform and a bottom surface of the upper platform configured to compress under a load applied to a top surface of the upper platform; and the plunger assembly includes a first locking finger, wherein the first locking finger is configured to engage with a first locking aperture of the enclosure when the at least one isolation damper is compressed under the load applied to the top surface of the upper platform;

wherein the plunger assembly further includes a plunger, a plunger housing, a second locking finger, and a locking mechanism for locking and unlocking the first locking finger and the second locking finger.

2. The apparatus of claim 1, wherein the second locking finger is configured to engage with a second locking aperture of the enclosure when the at least one isolation damper is compressed under the load applied to the top surface of the upper platform.

3. The apparatus of claim 2, further comprising:

the plunger disposed in the plunger housing, wherein the locking mechanism is configurable to extend the plunger into the plunger housing to unlock the first locking finger from the first locking aperture and unlock the second locking finger from the second locking aperture.

4. The apparatus of claim 2, further comprising:

the plunger disposed in the plunger housing, wherein the locking mechanism is configurable to retract the plunger into the plunger housing to lock the first locking finger into the first locking aperture and lock the second locking finger into the second locking aperture.

5. The apparatus of claim 4, further comprising:

a first pin and rotational spring combination coupled to a first end of the first locking finger and coupled to the plunger housing, wherein the first pin and rotational spring combination is configured to extend and retract the first locking finger from the first locking aperture; and a second pin and rotational spring combination coupled to a first end of the second locking finger and coupled to the plunger housing, wherein the second pin and rotational spring combination is configured to extend and retract the second locking finger from the second locking aperture.

6. The apparatus of claim 5, wherein a first portion of the plunger housing prevents the first locking finger from pivoting at the first pin and rotational spring combination and a second portion of the plunger housing prevents the second locking finger from pivoting at the second pin and rotational spring combination.

7. The apparatus of claim 6, further comprising:

a second end of the first locking finger is configured to engage with the first locking aperture of the enclosure; and a second end of the second locking finger is configured to engage with the second locking aperture of the enclosure.

8. The apparatus of claim 2, further comprising:

a first cavity in the plunger housing of the plunger assembly, wherein a first pin disposed in the first cavity in the plunger housing couples the upper platform to the plunger housing; and a second cavity in the plunger housing of the plunger assembly, wherein a second pin disposed in the second cavity in the plunger housing couples the upper platform to the plunger housing.

9. The apparatus of claim 8, further comprising:

a first cavity guide in the enclosure, wherein the first pin is placeable in the first cavity guide during a movement of the plunger assembly in the vertical direction; and a second cavity guide in the enclosure, wherein the second pin is placeable in the second cavity guide during the movement of the plunger assembly in the vertical direction.

10. The apparatus of claim 1, wherein a distance that the at least one isolation damper compresses equals a distance that the plunger assembly compresses within the enclosure.

11. The apparatus of claim 1, wherein the at least one isolation damper at least partially surrounds the enclosure.

12. The apparatus of claim 1, further comprising:

the at least one isolation damper is a plurality of isolation dampers of varying heights and cross sections, wherein the plurality of isolation dampers are engaged for different weighted loads applied to the top surface of the upper platform.

13. The apparatus of claim 1, further comprising:

a cavity of the upper platform, wherein the enclosure is placeable in the cavity of the upper platform when the at least one isolation damper is compressed under the load applied to the top surface of the upper platform.

14. The apparatus of claim 1, wherein an engagement of the first locking finger with the first locking aperture prevents a movement of the upper platform in the vertical direction.

15. The apparatus of claim 1, wherein a difference in a first height of the first locking aperture and a second height of the first locking finger dictates a height movement of the upper platform in the vertical direction.

16. The apparatus of claim 1, further comprising:

the plunger assembly includes a second locking finger, wherein the second locking finger is configured to engage with a second locking aperture of the enclosure when the at least one isolation damper is compressed under the load applied to the top surface of the upper platform.

17. The apparatus of claim 16, wherein the first aperture is out of a first plurality of locking apertures of the enclosure arranged in the vertical direction and the second aperture is out of a second plurality of locking apertures of the enclosure arranged in the vertical direction.

* * * * *